US006282726B1

(12) United States Patent
Noyerie et al.

(10) Patent No.: US 6,282,726 B1
(45) Date of Patent: Sep. 4, 2001

(54) PROTECTIVE HELMET

(75) Inventors: Jean-Paul Noyerie, Abergement Clemenica; Louis Guay, Chatillon sur Chalaronne, both of (FR)

(73) Assignee: Gallet S.A., Chatillon sur Chalaronne (FR)

( * ) Notice: Subject to any disclaimer, the term of this patent is extended or adjusted under 35 U.S.C. 154(b) by 0 days.

(21) Appl. No.: 09/306,804

(22) Filed: May 7, 1999

(51) Int. Cl.[7] ..... A42B 3/00
(52) U.S. Cl. ..... 2/424; 2/6.4; 2/6.5
(58) Field of Search ..... 2/6.3, 6.4, 6.5, 2/6.7, 424, 8, 9, 10

(56) References Cited

U.S. PATENT DOCUMENTS 2,362,610 * 11/1944 Bowers ..... 2/8
2,419,649 * 4/1947 Lieg ..... 2/8
4,689,836 * 9/1987 Vitaloni ..... 2/424
4,769,857 * 9/1988 Cianfanelli et al. ..... 2/424
4,794,652 * 1/1989 Piech Von Planta et al. ..... 2/414

* cited by examiner

*Primary Examiner*—Michael A. Neas
(74) *Attorney, Agent, or Firm*—Greenblum & Bernstein. P.L.C.

(57) ABSTRACT

A protective helmet of the type with an external shell and at least two protective shields, a first shield and a second shield, each pivotable with respect to the shell between two positions, i.e., between a low active position of use and a high active position of non-use, wherein the first shield is articulated with respect to the shell around a first pivot axis, while the second shield is articulated with respect to the shell around a second pivot axis, with the transverse pivot axis of the first shield differing from the transverse pivot axis of the second shield.

6 Claims, 6 Drawing Sheets

PROTECTIVE HELMET

BACKGROUND OF THE INVENTION

1. Field of the Invention

The present invention relates to an improvement for a protective helmet, and more particularly for a helmet including at least two pivotable front protective shields.

2. Description of Background and Relevant Information

Protective helmets have been commonly used for a very long time in various fields, either professional, as is the case for military personnel, airplane or helicopter pilots, police officers or firefighters, or civilian or private, as is the case for users of motorcycles, rally or race cars, or employees of work sites.

There is no shortage of applications, and a large number of helmets which have a rigid external shell substantially spherical in shape adapted to closely fit the skull of the user, with a face opening at the front for the face, are already known. Moreover and generally, the helmet includes an internal envelope made of synthetic foam adapted to absorb shocks. Some helmets have a transparent face shield movable between a low protective position and a high retracted position. To that end, the shield is mounted on the helmet pivotably around a transverse axis, with the shield being displaced by pivoting to be positioned in front of the nose of the user.

Some helmets have a smaller second shield, or an eye shield, mounted to pivot coaxially with the face shield.

The result is that the second shield is pivoted into the low position under the same pivoting conditions as the face shield, adapted to cover the nose of the user. As a result, the eye shield in the low position is not in a good position.

SUMMARY OF THE INVENTION

An object of the invention is to overcome the drawbacks found in helmets having two pivoting shields by proposing a particularly simple construction according to which the respective axes of the two shields are not coaxial, but which are distinct and different in their positions, in contrast with the prior art helmets. Thus, because of the proposed construction, each of the shields has its own pivot path, appropriate to its destination.

Thus, the protective helmet according to the invention is of the type with an external shell and at least two protective shields, i.e., a first shield and a second shield, both pivotable with respect to the shell between two positions, i.e., between a low active position of use and a high inactive position of non-use, whereby the first shield is pivotable around a transverse axis different from the transverse pivot axis of the second shield.

According to further preferred characteristics, the first shield is a face shield with larger dimensions than the second shield. Thus, the two shields are each comprised of a transparent wall which is substantially a portion of a sphere, and the radius of the transparent wall of the first shield is greater than the radius of the transparent wall of the second shield, while in the low position of use and/or in the high position, the front wall of the second shield is arranged behind the front wall of the first shield.

In addition, according to a preferred embodiment, in the high position of use, the front wall of the second shield is substantially parallel to the front wall of the first shield.

According to another characteristic, the two shields are mounted to pivot on an internal intermediate part attached to the external shell.

It is also noted that, advantageously, the pivot axis of the second shield is arranged farther forward and higher than the pivot axis of the first shield.

BRIEF DESCRIPTION OF DRAWINGS

Other characteristics and advantages of the invention will become apparent from the following description, with reference to the annexed drawings which are only provided as non-limiting examples.

DETAILED DESCRIPTION OF THE INVENTION

Figure 1:
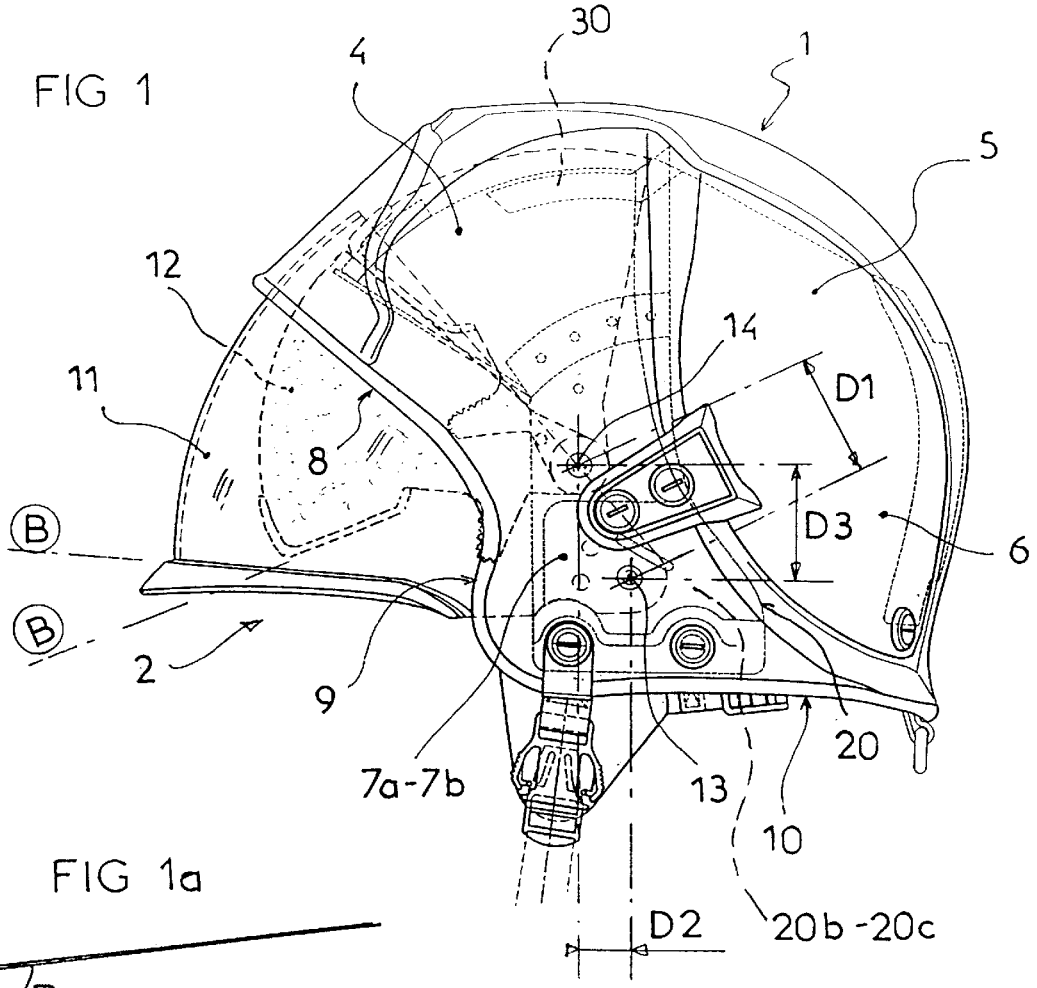
FIG. 1 is a side view of the helmet of the invention, with the two shields in the low position of use.
Figure 1A:
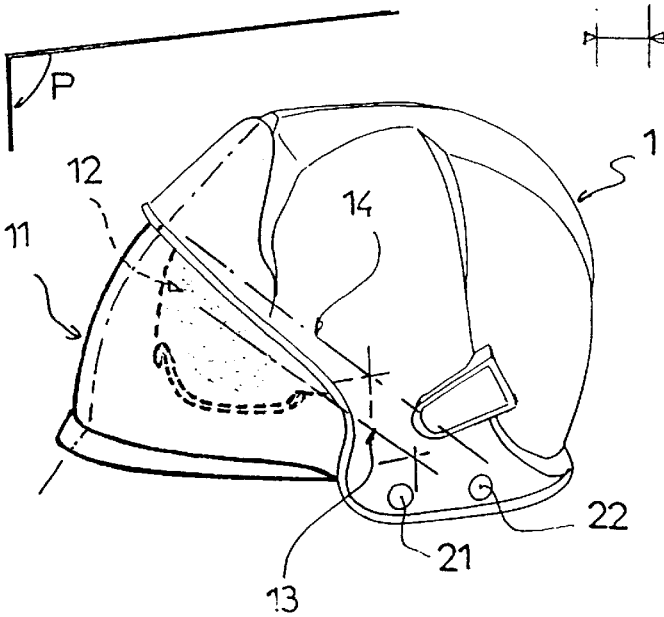
FIG. 1*a* is a perspective view of the helmet of the invention, with the two shields in the low position of use.

The helmet equipped with the protective shields according to the invention may be of any kind, such as, for example, the type used by firefighters, military personnel, or motorcyclists, even bikers or skiers, and has a primary external shell 1 protecting the cranium and the nape of the neck of the user and has a front face opening 2 in the zone occupied by the actual face of the user, with the helmet having a vertical longitudinal plane of symmetry P.

The shell is made of a rigid material and may be of any appropriate material such as plastic, steel, aluminum, or a composite material of the type having a stack of layers of reinforcement fibers, impregnated and interconnected by a resin matrix. The external shell is made up of a substantially spherical wall having a plurality of wall portions, i.e., a front top wall 4 extended toward the rear by a rear top wall portion 5, itself extended toward the bottom by a rear bottom wall portion 6, and has, moreover, two side wall portions 7, a right side wall portion 7*a*, and a left side wall portion 7*b*. The front top wall portion 4 corresponds to the zone occupied by the forehead of the user and is demarcated by the top rim 8 of the face opening 2, which is itself demarcated laterally by two side rims 9. The rear top wall portion 5 corresponds to the zone occupied by the cranium of the user, while the rear bottom wall portion 6 corresponds to the zone occupied by the nape of the neck of the user. In addition, the wall of the shell is demarcated toward the bottom by a lower rim 10. The side wall portions 7, 7*a*, 7*b* correspond to the zones occupied by the ears of the user and are demarcated toward the front by the corresponding side rim 9 of the face opening 2, and toward the bottom by the front ends of the lower rim 10.

The helmet of the invention has, according to one of its characteristics, at least two protective shields 11, 12 pivotable with respect to the shell 1, between two positions, i.e., between a low active position of use B and a high inactive position of non-use H.

Thus, the helmet has a first shield 11 and a second shield 12.

The first shield is a face shield with large dimensions adapted in its position of use to cover a large part of the face of the user, whereas the second shield 12 is an eye shield of smaller dimensions than the face shield adapted, more specifically, to protect the eyes of the user in the position of use.

Each of the protective shields is pivotable around a transverse axis and, according to the invention, the pivot axis of the first shield is distinct and different from the pivot axis of the second shield. Thus, the first shield or face shield 11 is articulated with respect to the shell 1 around a first pivot axis 13, whereas the second shield or eye shield 12 is articulated with respect to the shell 1 around a second pivot axis 14. Therefore, the two axes are not coaxial, but have different positions.

It must be remembered that, according to the invention, the second axis 14 is different from the first axis 13. Thus, the second axis 14 is spaced from the first axis 13 by a distance D1 to be farther forward than the first axis by a distance D2 and higher by a distance D3.

It is important to note that the shields 11, 12 are each mounted individually articulated with respect to the shell. Thus, their respective rotational movements occur around a fixed pivot axis in a locator linked to the shell. Moreover, the positioning of the pivot axes 13, 14 of the shields 11, 12 as well as the configuration, i.e., the shape and size, of the shields are selected to enable the shields to pivot freely and independently of each other between their respective extreme active and inactive positions. The pivoting of each of the shields is independent of the pivoting of the second shield; the respective paths of the shields 11, 12 are distinct and do not cross each other, such that regardless of the position of one of the shields, the second shield can pivot freely from its inactive position to its active position and vice versa. Thus, each of the shields has its own defined path and has the same path regardless of the other shield.

The first shield 11 is composed of a transparent wall made, for example, of a plastic material of the polycarbonate type or other type. This wall is substantially a portion of a sphere limited so as to be contained between two converging transverse planes P1, P2 forming a dihedral angle A open toward the front. The face shield is composed of a front wall 11*a* formed by a substantially spherical portion with a radius R1 extended laterally toward the rear by two side arms 11*b*, 11*c*. The second shield 12 is composed of a transparent wall made, for example, of a plastic material of the polycarbonate type or another type. This wall is substantially a portion of a sphere limited so as to be contained between two converging planes P3, P4 forming a dihedral angle B open toward the front. The face shield is made up of a front wall 12*a* formed by a substantially spherical portion with a radius R2 extended laterally toward the rear by two side arms 12*b*, 12*c*. In addition, the angle A formed by the two planes P1, P2 is larger than the angle B formed by the two planes P3, P4, and the radius R1 of the spherical wall of the first shield 11 is greater than the radius R2 of the spherical wall of the second shield 12.

Figure 2:
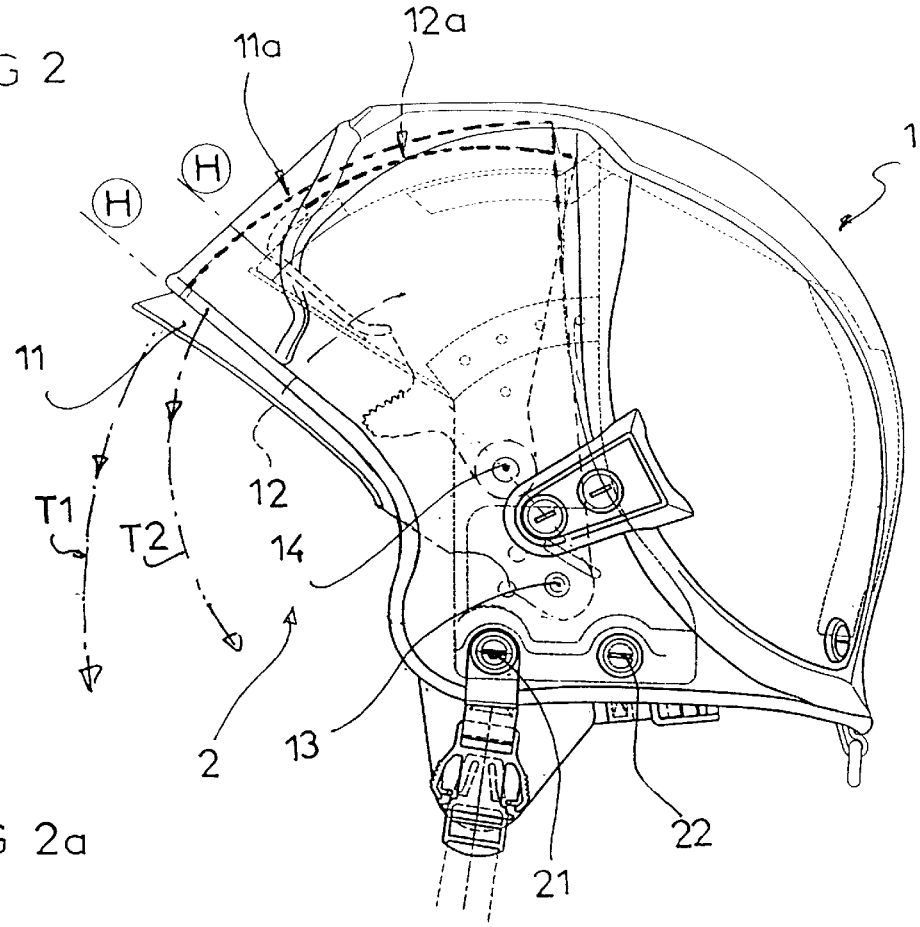
FIG. 2 is a side view of the helmet of the invention, with the two shields in the high inactive position of non-use.
Figure 2A:
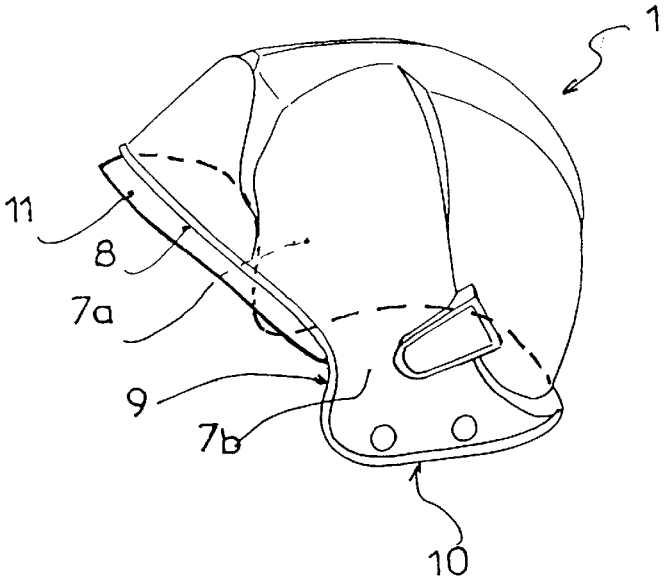
FIG. 2*a* is a perspective view of the helmet of the invention, with the two shields in the high inactive position of non-use.
Figure 3:
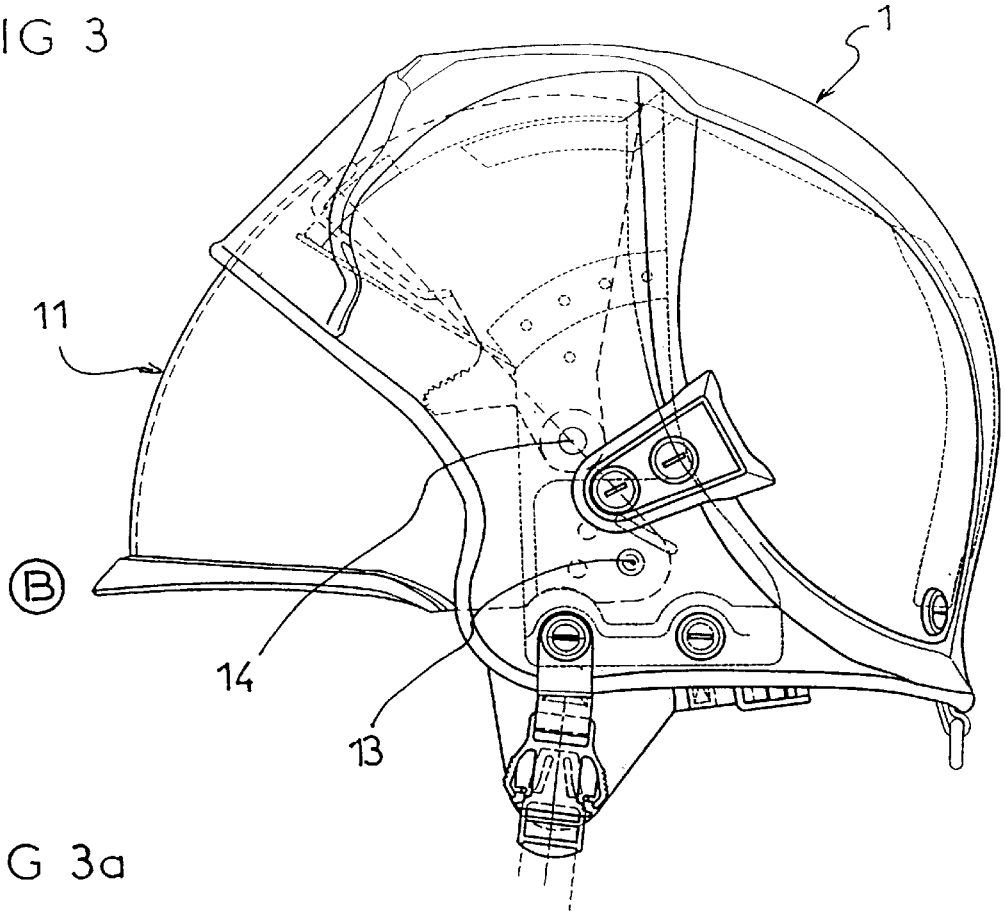
FIG. 3 is a side view of the helmet of the invention with only the first shield in the low position of use.
Figure 3A:
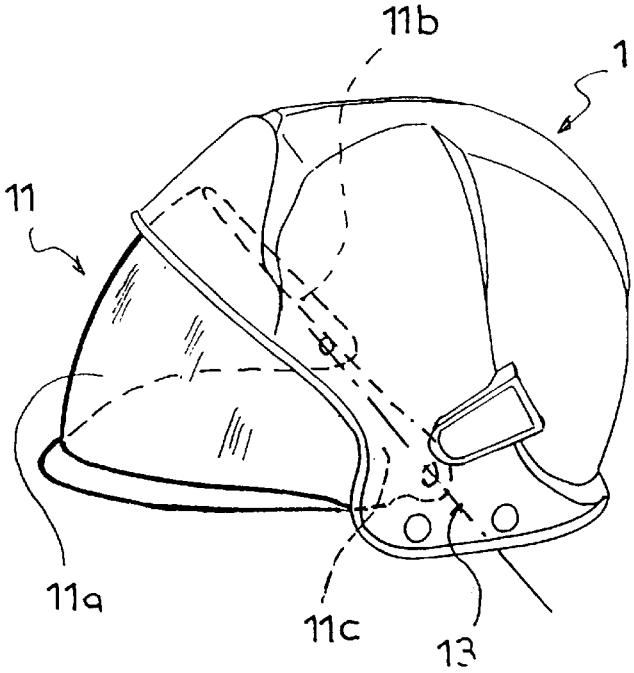
FIG. 3*a* is a perspective view of the helmet of the invention with only the first shield in the low position of use.
Figure 4:
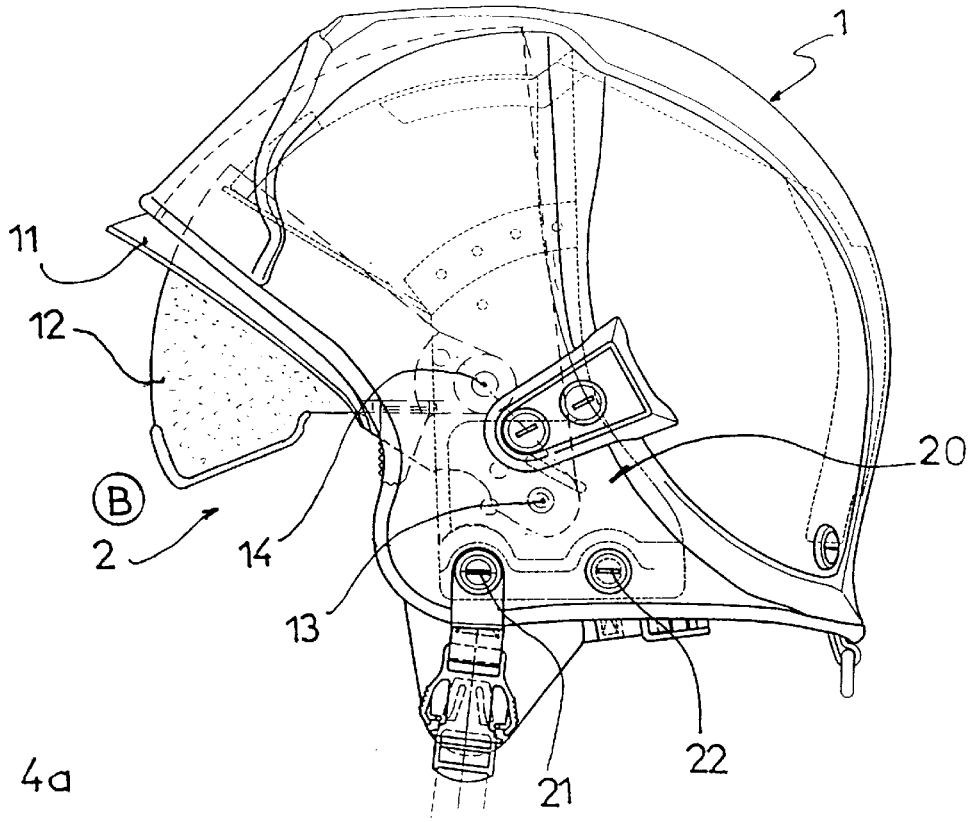
FIG. 4 is a side view of the helmet of the invention with only the second shield in the low position of use.
Figure 4A:
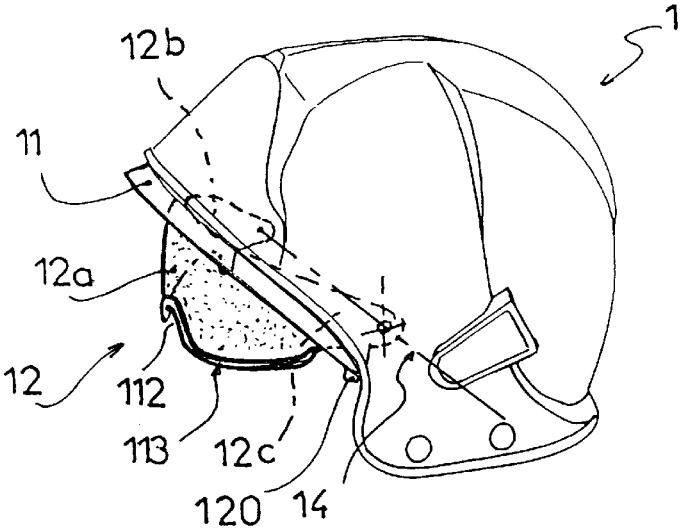
FIG. 4*a* is a perspective view of the helmet of the invention with only the second shield in the low position of use.
Figure 5:
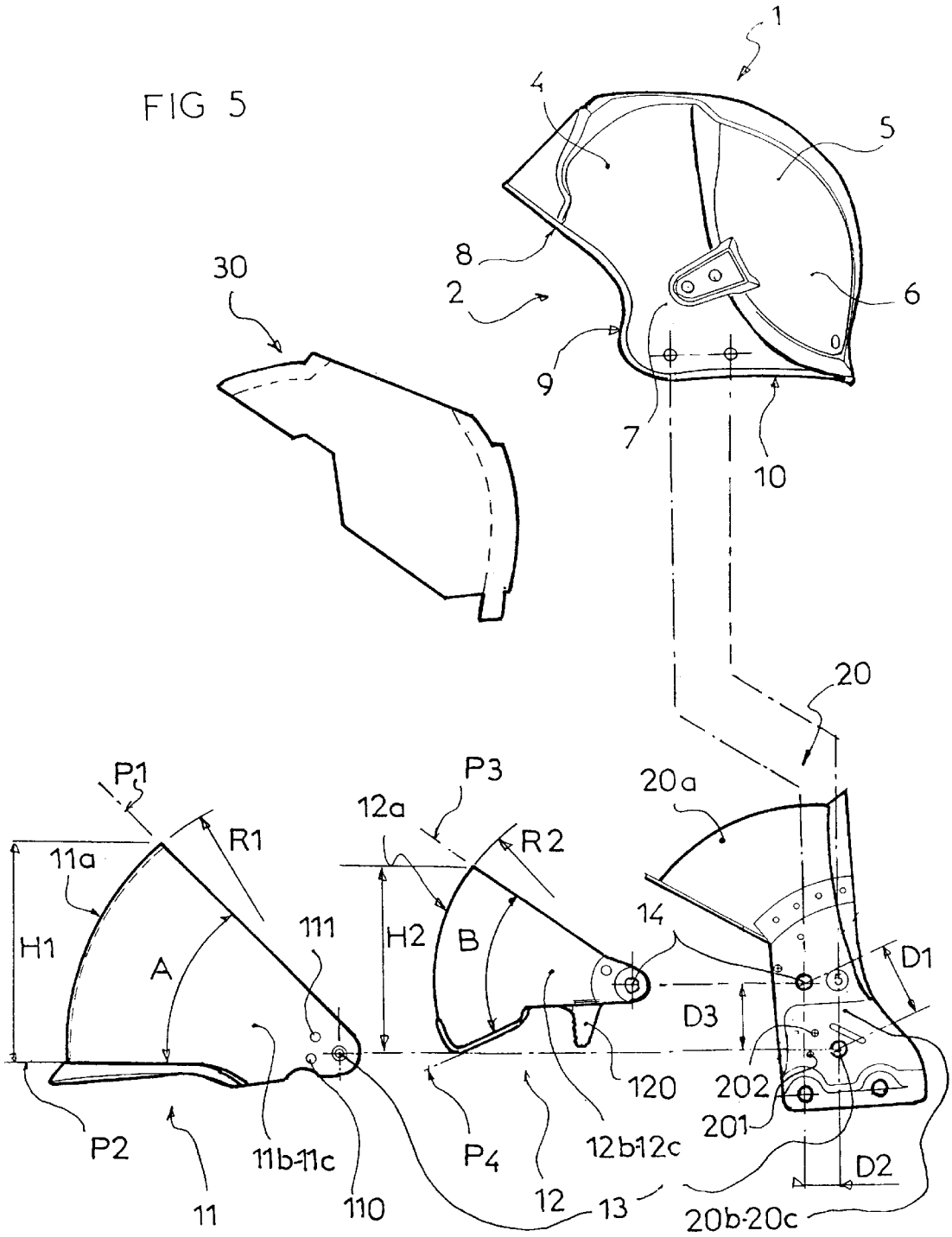
FIG. 5 is an exploded side view of the helmet depicting the essential elements of the helmet.
Figure 6:
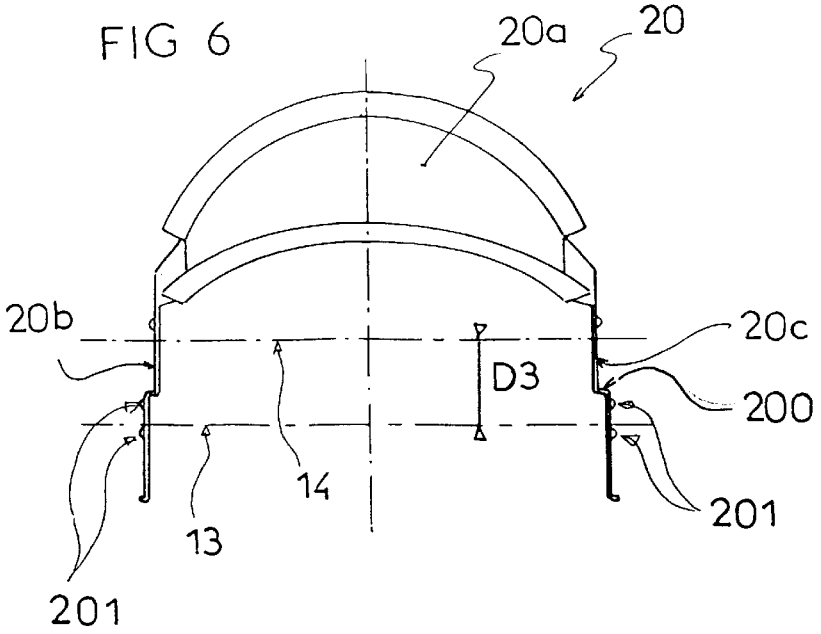
FIG. 6 is a front view of the internal intermediate part.

As described previously, the second shield 12, or ocular shield, has smaller dimensions than the first shield 11, or face shield. Thus, the front wall 11*a* of the first shield 11 has a height H1, measured in the plane P of general symmetry, which is greater than the height H2 of the front wall 12*a* of the second shield 12, measured under the same conditions. Also, the radius R1 of the front wall 11*a* of the first shield 11 is greater than the radius R2 of the front wall 12*a* of the second shield. Also, as is clearly seen in the drawings, in the low position of use B and/or in the high position H, the front wall 12*a* of the second shield 12 is arranged behind the front wall 11*a* of the first shield 11, and in the high position of use H, the front wall 12*a* of the second shield is substantially parallel to the front wall 11*a* of the first shield 11, as appears more specifically in FIG. 2. In addition, the dihedral angle A formed by the plane P1, P2 including the first shield 11 is larger than the dihedral angle B formed by the plane P3, P4 including the second shield.

According to an advantageous arrangement, the two shields 11, 12 are not mounted directly on the shell 11 but on an internal part 20 attached to the interior of the helmet on each of its sides, by utilizing two attachment bolts 21, 22 or any other mechanism.

Figure 7:
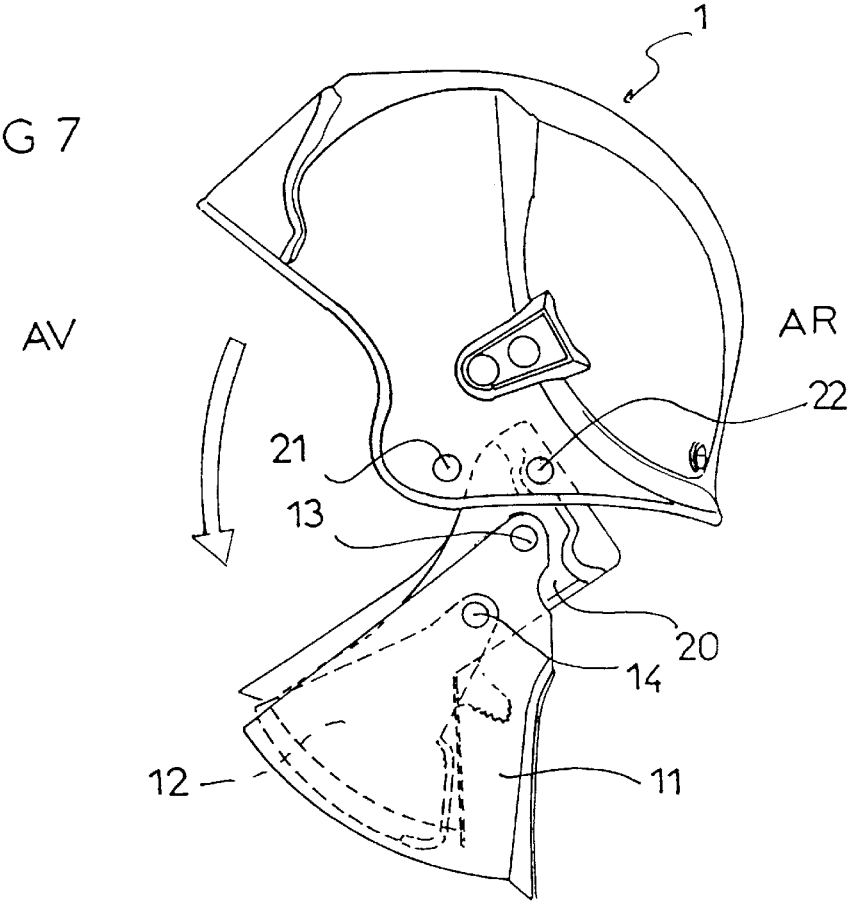
FIG. 7 is a side view of the helmet after the internal intermediate part bearing the two shields has been pivoted toward the front.

This internal part 20 appears in the form of a top spherical wall portion 20 *a* extended laterally toward the bottom by two side walls 20*b*, 20*c*, with the two shields mounted pivotably on these side walls, while the bottom rim of the side walls is attached in the vicinity of the side rim 10 of the side walls 7*a*, 7*b* of the shell 1 by the aforementioned bolts or screws 21, 22. Thus, as depicted in FIG. 7, it is possible, after removing the front bolts 21, to pivot the unit composed of the internal intermediate part 20 with the two shields 11, 12, which enables cleaning or possibly replacing the shields whose joints are then outside the shell 1, and therefore perfectly accessible.

It is noted that a protective, shock-absorbing padding commonly called a skull-cap 30 made of synthetic foam, such as expanded polystyrene foam or polyurethane foam, with the skull-cap 30 providing the actual protection of the skull of the user.

To facilitate the pivot maneuvers of the eye shield 12, at least one gripping member composed of a tab 120 formed by a downward extension of one or both of the side arms 12*b*, 12*c* is advantageously provided. Also, the gripping tab is arranged in proximity to the face opening 2 and, more specifically, to the side rim 9 to be able to be readily accessible to the user.

Moreover, it is possible to provide mechanism to retain one or both shields in the low and/or high position to implement a sort of position indexing of one or both extreme positions of the corresponding shield such that the extreme position(s) is(are) correctly defined.

In order to correctly define the pivot positions, it is noted that a stop system restricting the downward and/or upward pivoting of one or both of the shields could also be provided. Also, the pivoting of one or both shields could be free or retarded, for example, by friction at the level of its joint 13 and/or 14, or elsewhere in an appropriate zone.

Thus, according to the exemplary embodiment, a stop restricting downward pivoting of the face shield 11 is provided, with the stop composed of a side flange 200 implemented in the side walls 20*b*, 20*c* of the internal intermediate part 20. Moreover, the first shield is indexed and retained in its low and high position by the cooperation of protrusions 201, 202 implemented in the lateral walls 20*b*, 20*c* of the internal intermediate part 20 with corresponding holes 110, 111 implemented in the side arms 11*b*, 11*c* of the shield 11. The same is true of the eye shield.

It is discernible from the drawing that, at the time of its pivoting, the eye shield, more specifically its front wall 12*a*, has a very short path T2 such that the shield is very close to the face, particularly to the eyes of the user, as are simple goggles.

In fact, a central indentation 112 open toward the bottom, adapted to the passage of the nose of the user is advantageously provided, with a comfort and finishing gasket 113 also provided on the bottom rim of the shield. During pivoting, the face shield 11 has, of course, a more distant path T1, enabling the shield to move forward and beyond the zone occupied by the nose of the user.

It is to be understood that the user may place either one or the other of the shields individually, or both shields simultaneously, in the low or high position.

The invention is not to be limited to the embodiments that have been specifically described and shown by way of example, but it also includes all equivalent structures and combinations thereof.

What is claimed is:

1. A protective helmet of the type comprising an external shell and at least two protective shields, a first shield and a second shield, each said shield being pivotable with respect to the external shell between two positions, said two positions being a low active position of use and a high inactive position of non-use, said first shield being articulated with respect to said external shell around a first pivot axis, and said second shield is articulated with respect to said external shell around a second pivot axis, said transverse pivot axis of said first shield being different from said transverse pivot axis of said second shield;

wherein said first shield is a face shield with larger dimensions than said second shield, said second shield being an eye shield;

wherein said two shields are each composed of a transparent wall, each said transparent wall being substantially a portion of a sphere.

2. A protective helmet according to claim 1, wherein said transparent wall of said first shield has a radius greater than a radius of said transparent wall of said second shield.

3. A protective helmet according to claim 2, wherein in said low position of use and/or in said high position of non-use, said second shield has a front wall arranged behind a front wall of said first shield.

4. A protective helmet according to claim 3, wherein in said high position of use, said front wall of said second shield is substantially parallel to said front wall of said first shield.

5. A protective helmet of the type comprising an external shell and at least two protective shields, a first shield and a second shield, each said shield being pivotable with respect to the external shell between two positions, said two positions being a low active position of use and a high inactive position of non-use, said first shield being articulated with respect to said external shell around a first pivot axis, and said second shield is articulated with respect to said external shell around a second pivot axis, said transverse pivot axis of said first shield being different from said transverse pivot axis of said second shield;

wherein said two shields are mounted to pivot on an internal intermediate part attached to said external shell.

6. A protective helmet of the type comprising an external shell and at least two protective shields, a first shield and a second shield, each said shield being pivotable with respect to the external shell between two positions, said two positions being a low active position of use and a high inactive position of non-use, said first shield being articulated with respect to said external shell around a first pivot axis, and said second shield is articulated with respect to said external shell around a second pivot axis, said transverse pivot axis of said first shield being different from said transverse pivot axis of said second shield;

wherein the pivot axis of said second shield is arranged farther forward and higher than the pivot axis of said first shield.

* * * * *